United States Patent [19]

Fletcher et al.

[11] 4,103,619

[45] Aug. 1, 1978

[54] ELECTROEXPLOSIVE DEVICE

[76] Inventors: James C. Fletcher, Administrator of the National Aeronautics and Space Administration, with respect to an invention of; Vincent J. Menichelli, Glendale, Calif.

[21] Appl. No.: 740,153

[22] Filed: Nov. 8, 1976

[51] Int. Cl.[2] ..... F42C 19/12

[52] U.S. Cl. ..... 102/28 R

[58] Field of Search ..... 102/28 R, 28 M; 338/20; 252/516

[56] References Cited

U.S. PATENT DOCUMENTS

| | | | |
|---|---|---|---|
| 2,802,422 | 8/1957 | Horne | 102/28 R |
| 3,082,691 | 3/1963 | Evans et al. | 102/28 R |
| 3,135,200 | 6/1964 | Jackson | 102/28 R |
| 3,175,492 | 3/1965 | Reyne et al. | 102/28 R |
| 3,227,083 | 1/1966 | Moses et al. | 102/28 R |
| 3,274,937 | 9/1966 | Kyle | 102/28 R |
| 3,310,766 | 3/1967 | Downing et al. | 338/20 |
| 3,318,243 | 5/1967 | Miller | 102/28 M |
| 3,496,512 | 2/1970 | Matsuoka et al. | 338/20 |

OTHER PUBLICATIONS

Murphy, New Test for EED's, Weapons Technology, Nov.-Dec. 1972, pp. 236-239.

Hawley, The Condensed Chemical Dictionary, 8th Ed., Van Nostrand Reinhold Co., p. 271.

*Primary Examiner*—Verlin R. Pendegrass
*Attorney, Agent, or Firm*—Monte F. Mott; John R. Manning; Paul F. McCaul

[57] ABSTRACT

An improved electroexplosive device employs a header having contact pins hermetically sealed with glass passing through from a connector end of the header to a cavity filled with a shunt layer of a new nonlinear resistive composition and a heat-sink layer of a new dielectric composition having good thermal conductivity and capacity. A bridge circuit placed across the contact pins in contact with the heat-sink layer is welded to the pins. The header is inserted into a body for the device and welded for a hermetic seal between the connector end and the bridge end. Layers of igniter and output charges are placed in the body over the heat-sink layer and bridge circuit. A closure disk is then placed over the charges and welded to the body to form a hermetic seal. The nonlinear resistive layer and the heat-sink layer are prepared from suitable comminuted materials by mixing with a low temperature polymerizing resin. The resin is dissolved in a suitable solvent and later evaporated. The resultant solid composite is ground into a powder, press formed into the header and cured (polymerized) at about 250° to 300° F.

9 Claims, 4 Drawing Figures

ELECTROEXPLOSIVE DEVICE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; U.S.C. 2457).

BACKGROUND OF THE INVENTION

This invention relates to electroexplosive devices, and more particularly to protection of electroexplosive devices from electrostatic and radio frequency (RF) ignition and to a composition and method of making a nonlinear resistive shunt and heat-sink to protect an electroexplosive device.

Electroexplosive devices have been in commercial use at least since 1933 when U.S. Pat. No. 1,924,342 was granted to Harvey B. Alexander for a delay cap in which a bridgewire is heated under the influence of electric current supplied from a suitable source through lead wires. The early electroexplosive devices were not very sensitive in that the bridgewires were so selected that significant current would be required to ignite the explosive material. Otherwise an electrostatic charge caused by atmospheric electricity or electromagnetic radiation could produce enough current in the lead wires to heat the bridgewire sufficiently to ignite the explosive material.

As electroexplosive devices have come into greater use, protective devices have been sought to guard against premature ignition, as evidenced by a U.S. Pat. No. 2,247,384 granted in 1941 to Daniel D. Huyett for a shunt placed across the lead wires until it was time to ignite the device. While one could guard against inadvertently connecting the lead wires to a voltage source, and even against electromagnetic radiation (as by properly shielding the lead wires), one could not so easily guard against an electrostatic charge discharging through the bridgewire or from the bridgewire to the case. A technique which has proven successful has relied upon the fact that electrostatic charges are of much greater voltage than that used for intentional ignition. The technique consists of using a shunt material which is nonlinear in behavior. That is, a high resistance is exhibited at voltages of the magnitude used for intentional ignition, and a low resistance at voltages necessary for an electrostatic discharge in air which produce currents sufficient to ignite the device, as described in U.S. Pat. Nos. 2,408,124 and 2,408,125 granted in 1946 to Haus J. Rolfes.

An electroexplosive device useful in igniting various explosive compositions in many different applications, such as solid propellant rocket motors, bombs, seismic charges, land and sea mines, underwater demolition explosives, jet assisted takeoff (JATO) units and other similar types of units, have been commonly referred to as a squib. Although reference will be made hereinafter to a squib in describing an improved, low cost electroexplosive device for use aboard spacecraft and aircraft, it should be understood that the use of the term "squib" is not to imply that the present invention is to be limited to those applications enumerated above, but is rather to be expressly intended to apply to any electroexplosive device (EED) which comes within the terms and true spirit of the invention as defined by the claims.

EEDs are in general relatively small, ranging from 0.090-inch in diameter and 0.150-inch in length to 0.5-inch in diameter and 1.0-inch in length. There are exceptions (e.g., blasting caps vary in length but are generally 0.25-inch in diameter). The bridgewire circuit is generally insulated from the case of the EED, and when one considers the above dimensions it becomes obvious that the spacing between the bridgewire circuit and the external housing becomes quite small, in the order of 0.050-inch. The combination of small gaps and the sensitiveness of primary high explosives (which are loaded on or in these gaps) create the condition for possible inadvertent spark activation.

This condition is most critical when personnel are handling the EEDs. It has been demonstrated that the human body can accumulate electric charges and potentials large enough to cause spark discharges resulting in EED activation. The spark discharge characteristics of the human body vary depending on the body area from which the sparks are drawn (e.g., the hand, finger, or a metal object in the hand). However, the rate of discharge and total energy available from these areas is sufficient to initiate primary high explosives and pyrotechnic materials. There have been cases of inadvertent activation of EEDs attributable to electrostatic discharges from the human body and other sources.

In evaluating an EED for its susceptibility to static discharges, a number of tests and conditions are applied. Under ideal conditions the human body can develop a potential of approximately 25K volts. The average capacitance of the body is about 500 picofarads. The resistance to a discharge emanating from a finger tip is arbitrarily chosen to be about 5,000 ohms. From this information a general test subjecting EEDs to the discharge of a 500 picofarad capacitor charged to 25K volts within a 5,000 ohm resistor in series is often specified. There are variations to this test in which the capacitance, voltage and/or resistance are varied depending on the capability of the EED being tested. The design goal for an EED is usually to meet the 500 picofarad, 25K volts, 5,000 ohm specification. A variety of techniques have been applied to circumvent static discharges away from the sensitive explosive area of EEDs as noted hereinbefore. One recent approach is to purposely create a very small external spark gap between contact pins and an external housing. This technique has allowed EEDs to meet static discharge tests, but control of the gap is difficult and, more seriously, the gap is exposed to the environment, making it vulnerable to changing conditions (dirt, moisture, atmosphere) which can alter its behavior.

Another more recent approach to avoid electrostatic discharge accidents is the use of a varistor shunt, which is made from nonlinear material that becomes highly conductive when a potential gradient above a certain critical value is applied to it. The shunt is usually installed between the connector contact pins external to the hermetically sealed charge. One prior EED (designed for one ampere and one watt no-fire characteristics) uses silicon carbide particles suspended in a room temperature vulcanizable (RTV) rubber as the shunt. Evaluation of this shunt showed that it became conductive at about 400 volts (at the time of fabrication). The voltage at which conductance occurred was not consistent from unit to unit, and not repeatable for the same unit. Repeated testing of the same unit resulted in the clamp voltage increasing directly with the number of tests. Also, an aging phenomenon appears to take place since units which were two years old required about 700 volts to cause conductance. Each passage of an electrostatic discharge through the shunt caused appreciable carbonization of the RTV, so that after multiple discharges, the shunt performed more like a carbon resistor than a nonlinear resistor.

The bridgewire circuit at the end of the contact pins in the EED can absorb radio frequency energy from, for instance, a nearby radar or radio transmitter. If the electric current from such energy flowing through the bridgewire is sufficiently high, it could activate the EED. Thus the problem is to fabricate a material in contact with the bridgewire within the EED which will absorb sufficiently large amounts of thermal energy developed by random currents, yet its thermal capacity must be small enough that it does not dissipate all the heat generated by the current applied to the bridgewire when it is desired to activate the EED. The best solution has been to machine an aluminum oxide cup (a good thermal conductor and dielectric barrier) into which the terminals and the explosive or pyrotechnic material are placed, and allow it to become the substrate for the bridgewire. The explosive or pyrotechnic material is then pressed into the cup and onto the bridgewire. Due to the high loading pressures required and the build-up of tolerances that occur during machining of the aluminum oxide cup and the body of the EED, the cup (aluminum oxide being very brittle) can develop cracks during the loading, resulting in unpredictable performance, particularly after a long storage time. Further, particles of explosive can migrate into the cracks, causing increased electrostatic instability.

OBJECTS AND SUMMARY OF THE INVENTION

An object of this invention is to provide a simple low cost EED with greater reliability against inadvertent electromagnetic or electrostatic charge ignition than has heretofore been possible.

Another object is to provide an improved nonlinear resistive shunt in an EED to guard against inadvertent electromagnetic or electrostatic charge ignition.

Yet another object is to provide a new and improved nonlinear resistive composition which can be formed into any desired shape between two electrodes and cured at relatively low temperatures.

These and other objects and advantages of the invention are achieved in a hermetically sealed unit comprised of a keyed connector coupled to a body section loaded with explosives and a header between the connector and the body. The header is comprised of an insert having an external configuration matching a passage through the body into which it is inserted from the explosive end of the body, with a larger dimension in the end through which the header is inserted than in the other end of the passage to prevent the header from blowing out the other end of the body when the explosive is ignited. At least two electrical contact pins pass through the insert into the connector and are glass sealed to provide a hermetic seal and electrical isolation of a bridgewire across the ends of the pins in the body. The pins protrude from the insert at both ends: at the connector end to allow coupling to a cable; and at the body end to permit a layer of nonlinear resistive composition to be molded into a surrounding cavity in the insert. The composition is comprised of a powdered material selected from a group consisting of a semiconducting material, such as silicon carbide, or a metal oxide such as a composition of ZnO and BiO, which exhibits a nonlinear voltage-current characteristic, and a resin binder selected to polymerize at a low temperature (about 250° to 300° F). A layer of heat-conductive dielectric composition (boron nitride in a diallyl phthalate resin) is placed over the nonlinear resistive composition and flush with the ends of the contact pins. A bridgewire, preferably a flat or ribbon wire, is placed over the heat-conductive dielectric composition and welded to the contact pins. Because the header is a separate component and not part of the body and connector assembly, it is much simpler to make the bridge circuit, including the nonlinear resistive composition which protects against inadvertent igniting of the explosives in the body by electromagnetic or electrostatic charges. Another advantage is that the header may be standardized for insertion into a body and connector assembly of an EED designed for any application. Once the header is thus assembled and inserted into the body, explosive is loaded into the body recess and onto the bridgewire circuit of the header from the open end of the body. A disk is placed over the open end in an annular recess of a sufficiently large dimension to permit full peripheral welding of the disk to the body, thus providing a hermetic seal.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
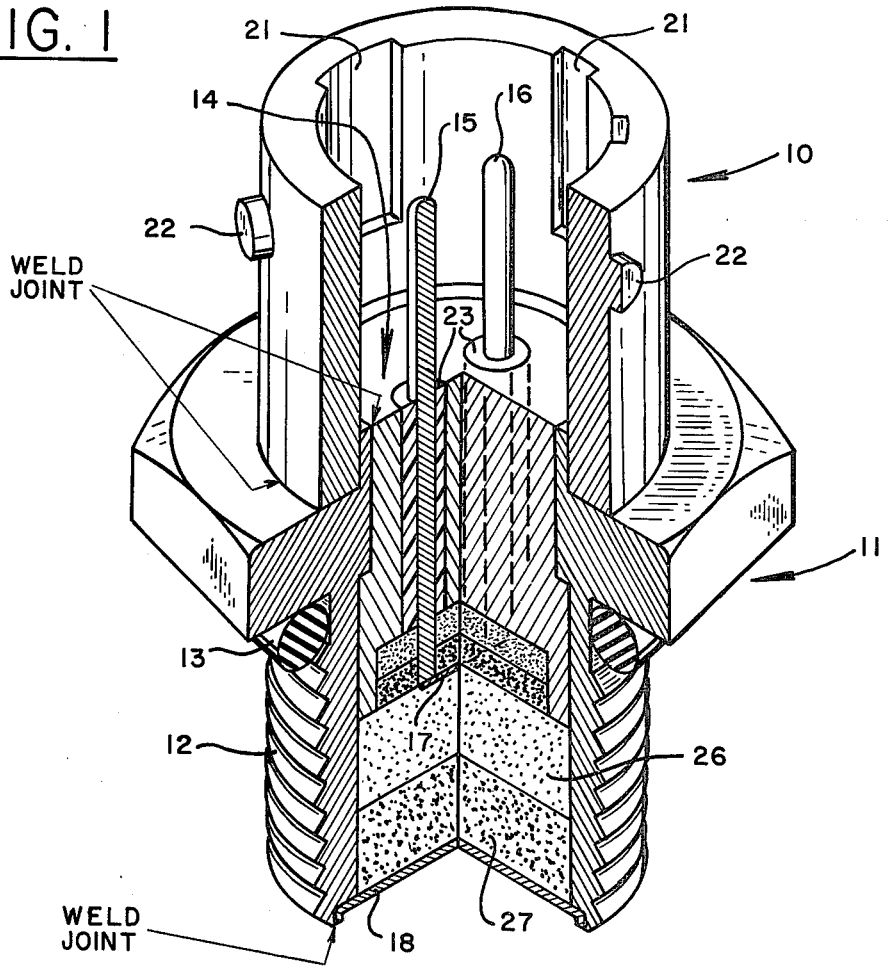
FIG. 1 is an isometric view of an improved single-bridge squib design embodying the present invention partially sectioned to show internal structure.

The aerospace community has adapted a 1-amp, 1-watt no-fire squib standard for use aboard spacecraft and aircraft. A new and improved squib design will allow meeting that standard in a much simpler manner than has heretofore been possible, as will be pointed out more clearly hereinafter. This simplicity leads to better quality and lower cost of a squib. FIG. 1 is a partially sectioned view of this advanced squib design embodying the concepts of the present invention. It can be configured externally for any application. Although a single-bridge circuit is illustrated, the concepts of the invention can easily accomodate a dual-bridge circuit.

Figure 4:
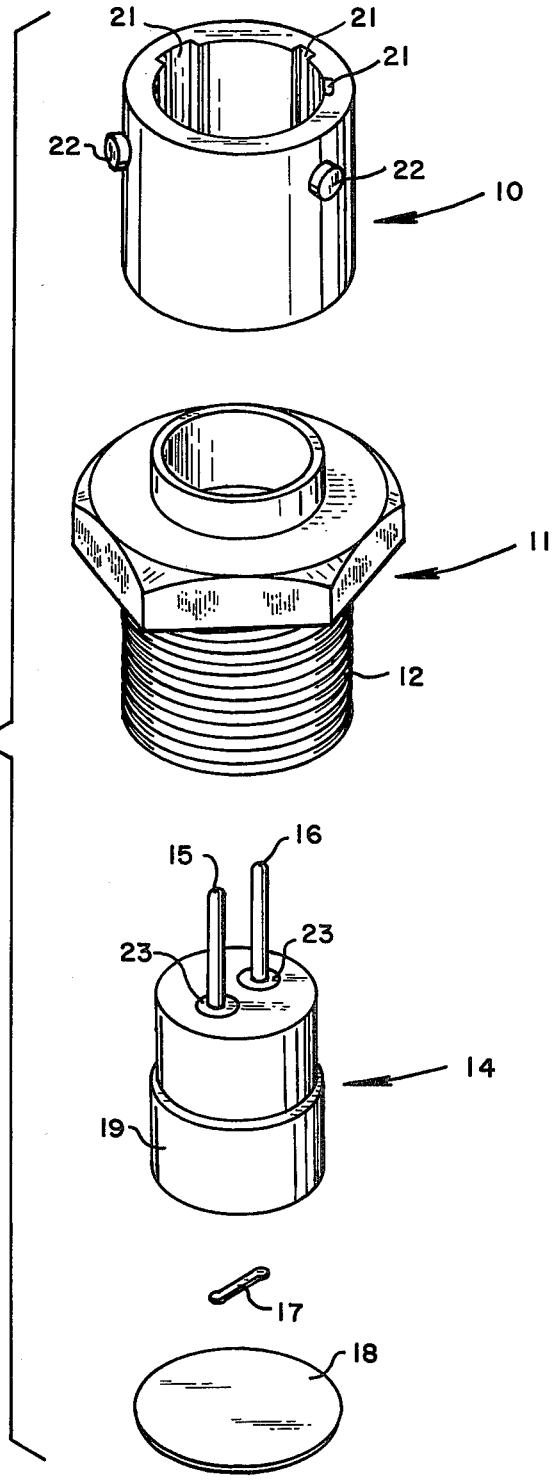
FIG. 4 is an exploded view of the squib shown in FIG. 1.

For simplicity of description, all of the figures will be referred to collectively, unless one particular figure is pointed out to refer more particularly to some design feature. The same reference numerals will, of course, be used for the same elements in the different figures. The exploded view of FIG. 4 is useful in better understanding the assembly of the basic components, particularly the sequence of the assembly. The design provides for hermetically sealing the explosive materials and consists of four basic components: a keyed connector 10; a body 11 having a threaded section 12 and an O-ring 13 (FIG. 1) against a hexagonal flange of the body 11 at the top of the threaded section; a header 14, which is assembled with contact pins 15 and 16 and a bridge wire 17 before it is inserted into the body 11; and a closure disk 18 placed over the open end of the threaded section of the body, after explosives have been loaded into the body.

Figure 2:
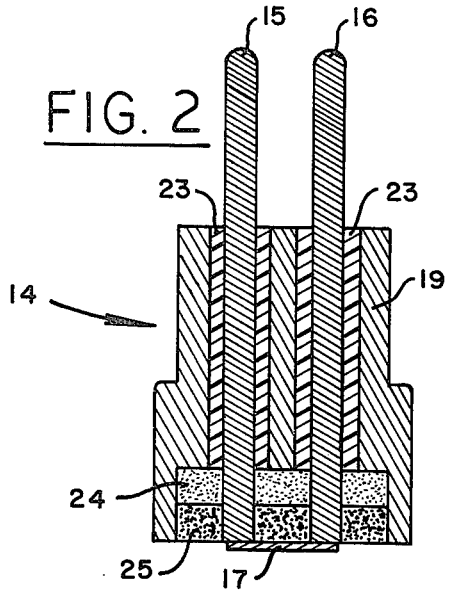
FIG. 2 is a full cross section of an internal header only partially sectioned in FIG. 1.
Figure 3:
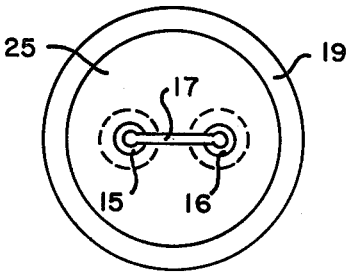
FIG. 3 is an end view of the full header shown in cross section in FIG. 2.

The header, shown in cross section in FIG. 2, is comprised of a metal insert 19 configured with a larger diameter at the bridgewire end to fit against a shoulder in the body 11 into which it is inserted, as shown in FIG. 1. The diameter and length of the other end of the insert is made to just fit into the upper end of the body, as viewed in FIG. 1, with the end of the insert flush with the end of the body. The annular joint is welded to provide a hermetic seal at the end of the body. Once the insert has been thus welded to the body, the connector 10 is placed over the upper end of the body and welded in place. But first the assembly of the header is completed, as will be described more fully with reference to FIG. 2. The connector has internal slots 21 and external lugs 22 of particular sizes and spacing for the particular application to permit only the correct cable to be coupled and locked on for connection to the pins 15 and 16. It is in that sense that the connector 10 is said to be keyed.

In practice, the header is formed as a cylindrical insert of the configuration shown in FIG. 2 with holes for the pins 15 and 16. Once the pins are inserted and centered in the holes, with the ends to which the bridge wire 17 is to be connected flush with the large diameter end, the pins are sealed with glass 23 to electrically isolate the pins from the metal insert and hermetically seal the holes. A cavity in the large diameter end of the insert 19 is then filled with a layer 24 of nonlinear resistive composition.

After the layer 24 of nonlinear resistive composition has been formed in place, a heat-sink layer 25 of thermal conductive dielectric composition is similarly formed in place to fill the cavity flush with the ends of the pins. The shunt layer 24 is capable of conducting repeated electrostatic discharges (about 25,000 volts and about 500 picofarads) without deteriorating, and the heat-sink layer 25 is capable of absorbing heat generated from the 1-amp, 1-watt, no-fire requirement and from repeated random electromagnetically induced currents without deteriorating. To function as a heat sink, the layer 25 must be flush with the ends of the pins 15 and 16. The bridgewire 17 between the pins is then in contact with the heat-sink throughout its full length.

This combination of shunt and heat-sink compositions is superior to the shunt material in the most recent development of squibs, namely silicon carbide particles suspended in a room temperature vulcanizable (RTV) rubber at the base of the pins on the connector side. Placing the shunt composition on the bridgewire side of the header has the further advantage of shortening the conductive loop into which electromagnetic energy may induce currents. Any small currents that may nevertheless be induced into the very small loop will tend to heat the bridgewire, but such small heat is easily dissipated by the heat-sink layer in thermal coupling with the body 11 through the header insert 19. Only a signal greater than 1-amp and 1-watt intentionally conducted through the bridgewire will heat it sufficiently to ignite the squib.

Once the header has been thus assembled, it is placed in the body 11 with the connector end of the insert 19 flush with the upper end of the body as viewed in FIG. 1. The header is welded to the body around the entire circumference of the header to hermetically seal the joint. Then the connector is placed over the end of the body and welded in place. The cavity which remains between the bridgewire circuit of the header and the open end of the threaded section 12 of the body 11 is loaded with first a layer 26 of igniter charge, and then a layer 27 of output charge. The closure disk 18 is then welded in place over the end of threaded section 12. That end is recessed to receive the disk, and the recess is of a diameter greater than the internal diameter of the threaded section so that the entire circumference of the disk may be welded to the threaded section for a hermetic seal and allow sufficient heat-sinking during welding so as not to ignite the output charge.

In summary, the objects of the present invention are achieved by making a nonlinear resistive shunt of a new composition that is easily formed within the header and is capable of bypassing repeated electrostatic discharges without deteriorating, and providing a heat-sink (fabricated in a manner similar to the shunt) in thermal contact with the bridgewire using a new composition that is easily formed within the header and is capable of absorbing heat generated from repeated random induced currents without deteriorating. The nonlinear resistive shunt must have the following functional characteristics: It must not shunt or bypass the voltage (up to about 100V) applied to the terminals when it is desired to operate the EED; it must, however, act as a low impedance conductor for applied electrostatic voltages (for conservative design, this is considered to be any voltage greater than about 300V); further it must have a very long shelf life and conduct electrostatic discharges a very large number of times without deteriorating. It should be in the form of a homogeneous mass (i.e., not granular) so that it maintains its shape and characteristics throughout its lifetime.

The nonlinear resistive shunt is formed from a composition comprised of a powdered mixture of a resin which polymerizes at a low temperature and a nonlinear resistive material selected from a group consisting of a semiconducting material, such as silicon carbide (about 400 microns diameter), or a metal oxide, such as a mixture of ZnO or BiO in about a 95 to 5 ratio by weight. Once the resin of the powdered composition is polymerized, a nonlinear resistive shunt is provided of a permanent shape into which the powdered composition is pressed and cured. A suitable resin has been found to be diallyl phthalate (DAP) which requires low temperatures (about 250° to 300° F) for polymerization. Prior-art nonlinear resistive shunts were made from metal oxides which require sintering at high temperatures (about 1500° F), except for the RTV shunts referred to hereinbefore. Such high temperatures are unacceptable for forming the shunt directly in the body or header of an EED.

A typical but not limiting procedure for preparing the shunt composition is as follows. First dissolve the resin in a solvent, such as acetone, then mix the dissolved resin with powdered nonlinear resistive material using about 5 to 50% of resin. Next add a suitable catalyst, such as tert-butyl peroxybenzoate and evaporate the acetone using a hot water bath. The result is a solid that is comminuted for pressing into the desired form. In this case it is pressed into the cavity of the header around the contact pins to about half the depth of the cavity. Pressures from about 5,000 psi to 50,000 psi may be used.

Before the nonlinear resistive composition is cured into its pressed shaped, the heat-sink composition is similarly prepared using a resin solvent, mixing the dissolved resin with a suitable material, such as boron nitride (about 40 microns diameter), adding a suitable catalyst, evaporating the acetone, grinding the resultant solid into a powder, and pressing it into the cavity over the shunt composition flush with the ends of the contact pins. Boron nitride has excellent thermal conductivity, high thermal capacity, and is a very good dielectric. However, other materials having these qualities, such as silicon nitride, may be used. The resin of both the shunt and the heat-sink compositions is then polymerized in an oven preheated to about 250° F for about 15 minutes, or about 300° F for about 5 minutes. This is a curing operation for the resin resulting in a hard, inert structure.

To complete the header assembly, the bridgewire, preferably in a ribbon form, is welded across the contact pins. A ribbon form is preferred because the flat geometry of the ribbon provides greater surface area for welding the contact pins. By comparison with welding a wire, only point contact is made and deformation of the wire is necessary to make an effective weld. The wire operation is not consistent, so variation in the welds can be expected. Another advantage of using a ribbon form is the larger contact area with the heat-sink, thereby allowing more and consistent heat transfer from the bridge circuit. By comparison, a wire form provides only line contact at best and can be easily distorted to allow the explosive powders to destroy the line contact when the explosive powders are pressed in place.

The nonlinear resistive composition 22 and the heat-sink composition 23 precludes the need for any dielectric material lining the header, such as an aluminum oxide cup required in the prior art EED device referred to hereinbefore. The aluminum oxide cup contributed quite heavily to the cost of the EED, and because of the difficulty of seating it properly into the EED, it led to other problems, e.g., broken cups and bridgewires when the explosive was loaded.

Once the bridgewire 17 is welded, the completed header is inserted into the EED body and welded in place. The igniter charge 15 and the output charge 16 are then loaded. The closure disk 18 is then welded in place. Both welds are made over the full circumferential joints between the header and the body and between the disk and the body to provide a hermetic seal.

Although particular embodiments of the invention have been described and illustrated herein, it is recognized that modifications and equivalents may readily occur to those skilled in the art and consequently it is intended that the claims be interpreted to cover such modifications and equivalents.

What is claimed is:

1. In an electroexplosive device, a body having a passage and a header comprised of an insert having an external configuration matching said passage through said body such that said header will lodge in said passage at said one end leaving a space in said body for explosive materials to be loaded into said body behind said header, said insert having a cavity in the end thereof over which said explosive material is loaded, said header further comprising at least two electrical contact pins passing through said insert with ends of said pins protruding from said insert at said one end of said body passage, and with the other ends of said pins in said cavity of said insert flush with the cavity-end of said insert, a first layer of nonlinear resistive composition formed in said cavity of said insert in electrical contact with both pins, a second layer of thermal conductive dielectric composition over said layer of nonlinear resistive composition, and a bridgewire connected across the ends of said pins in thermal contact with said second layer over its full length between said contact pins.

2. The combination of claim 1 wherein said insert is made of metal and said pins are insulated from said insert by a hermetic seal of glass around said pins over the portions thereof passing through said insert.

3. The combination of claim 2 including a weld joint between said insert and said body, and further including a disk over said explosive material and a weld joint between said disk and said body, thus hermetically sealing said explosive material.

4. The combination of claim 5 further including a keyed connector on said body around said contact pins protruding from said insert at said one end of said body.

5. The combination of claim 4 wherein said keyed connector is secured on said body in proper space relation to said contact pins by a weld joint.

6. The combination of claim 1 wherein said nonlinear resistive composition is comprised of a nonlinear resistive material and a resin binder combined in comminuted form.

7. The combination of claim 6 wherein said nonlinear resistive material is silicon carbide.

8. The combination of claim 6 wherein said nonlinear resistive material is a composition of ZnO and BiO.

9. The combination of claim 6 wherein said resin binder is a diallyl phthalate resin.

* * * * *